US005865903A

United States Patent [19]

Duncan

[11] Patent Number: 5,865,903

[45] Date of Patent: Feb. 2, 1999

[54] SYSTEM AND METHOD FOR REMOVING LIQUID APPLIED TO HOLLOW CONTAINERS

[76] Inventor: James W. Duncan, 9257 Village Green Dr., Cincinnati, Ohio 45242

[21] Appl. No.: 785,292

[22] Filed: Jan. 21, 1997

[51] Int. Cl.[6] ..... B08B 9/14

[52] U.S. Cl. ..... 134/10; 134/21; 134/109; 134/166 R; 134/201; 68/19.1; 15/304

[58] Field of Search ..... 68/19.1, 20; 134/109, 134/166 R, 63, 61, 21, 10, 15, 201; 8/156; 15/304, 306.1, 309.1; 210/400, 406; 162/60, 366, 363, 364

[56] References Cited

U.S. PATENT DOCUMENTS

| | | | |
|---|---|---|---|
| 2,255,615 | 9/1941 | Frankel | 15/14 |
| 2,644,188 | 7/1953 | Pacilio | 15/304 |
| 2,698,624 | 1/1955 | Peters | 134/62 |
| 2,893,486 | 7/1959 | Marti | 162/364 |
| 3,024,839 | 3/1962 | Beachler | 162/364 |
| 3,568,238 | 3/1971 | Fischer | 15/306 |
| 3,629,058 | 12/1971 | Woodward et al. | 162/363 |
| 3,791,920 | 2/1974 | Nisser et al. | 162/364 |
| 3,986,274 | 10/1976 | Holm . | |
| 4,046,621 | 9/1977 | Sexton | 8/156 |
| 4,092,991 | 6/1978 | Rohrs | 134/127 |
| 4,097,306 | 6/1978 | Carman . | |
| 4,183,115 | 1/1980 | Zakarian | 15/302 |
| 4,447,924 | 5/1984 | Bolton et al. | 68/20 |
| 4,492,571 | 1/1985 | Miura . | |
| 4,680,088 | 7/1987 | Bastanzuri | 8/156 |
| 4,820,351 | 4/1989 | Hambleton et al. | 134/21 |
| 5,012,547 | 5/1991 | Marsh | 15/304 |
| 5,122,229 | 6/1992 | Seifert . | |
| 5,174,829 | 12/1992 | Gray | 134/21 |
| 5,265,298 | 11/1993 | Young | 15/1.51 |
| 5,271,164 | 12/1993 | Yoshimura et al. | 34/105 |
| 5,335,682 | 8/1994 | Yoshimura et al. | 134/72 |
| 5,356,481 | 10/1994 | Yoshimura et al. | 134/22.1 |
| 5,393,382 | 2/1995 | Corbellini et al. | 162/363 |
| 5,464,483 | 11/1995 | Avelis et al. | 134/25.4 |
| 5,487,200 | 1/1996 | Herzog | 15/1.51 |
| 5,517,834 | 5/1996 | Kappel et al. | 68/20 |

FOREIGN PATENT DOCUMENTS

| | | | |
|---|---|---|---|
| 2665196 | 1/1992 | France | 162/363 |
| 4241400 | 6/1993 | Germany | 162/363 |

*Primary Examiner*—Frankie L. Stinson
*Attorney, Agent, or Firm*—Andrus, Sceales, Starke & Sawall

[57] ABSTRACT

A liquid treatment system for hollow articles having an open end facing downwardly upon a moving conveyor belt includes a vacuum stripper tube connected to a blower for generating a suction force withdrawing excess liquid from the hollow articles and the belts, and a pair of flow splitters for distributing the suction force applied to opposite ends of the vacuum stripper tube. The system is provided with a baffle disposed in the vacuum stripper tube for improving the distribution of suction force in the vacuum stripper tube. The system also includes an excess liquid collection arrangement constructed and arranged to establish a one-way flow of and collect excess liquid evacuated from the vacuum stripper tube. The system further contemplates a blow-off unit operably connected to the blower for supplying dry air to the hollow articles and conveyor belt.

8 Claims, 4 Drawing Sheets

140
138
136
68
76
84
76
74
140
136
74
80
80
36
72
12
72
42
16
70
78
46
46
78
70
118
118
112
44
122
114
122
106
105
107
107
105
106
110
124
124
28

SYSTEM AND METHOD FOR REMOVING LIQUID APPLIED TO HOLLOW CONTAINERS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates broadly to liquid treatment of hollow articles and, more particularly, pertains to improvements in the removal of liquid applied to inverted cans transported upon a conveyor belt moving through a can washing apparatus.

Newly formed metal food and beverage cans are typically cleaned of forming oils and other contaminants in a high volume can washer in which masses of upstanding or inverted cans are moved on a mesh conveyor between banks of water supply pipes or risers to each of which a plurality of particularly oriented spray nozzles are attached. By carefully controlling nozzle orientation, flow and pressure, the cans may be moved through the washer supported solely from below by the wire mesh conveyor belt on which the cans are carried.

In a typical can washer, as many as six separate liquid treatment stations are provided in serially connected orientation with the cans conveyed by the conveyor belt through, for example, pre-wash, acid cleaning, rinse, surface fixing, and two final rinse stations. Each station has its own underlying liquid collection tank and, to enhance recycling and prevent cross-contamination caused by the conveyor belt moving through multiple stations, it is desirable to remove as much liquid as possible from the cans and the belt as the cans move from one station to the next. Below the belt, a number of different devices may be used, including brushes which contact the underside of the belt or a vacuum stripper system which runs the full lateral width of the belt to extract excess liquid from the belt and the cans. In addition, compressed air blow-off units forming a blow-off system are positioned above the cans on the belt as they exit each treating station. The blow-off system blows free liquid out of the dished bottoms of the inverted cans and provides a flow of drying air.

The vacuum stripper system in the can washing system described above includes a vacuum tube sometimes provided with a pair of splitters which serve to distribute the vacuum applied to opposite ends of the tube so that the center of the tube receives a divided flow. In many instances, this flow modification proves to be insufficient such that the removal of excess liquid from the cans and belt by vacuum is less than desired. Because the conveyor belt is subjected to various substances, the excess liquid removed from the belt and the cans is often contaminated. Contaminated excess liquid evacuated from the vacuum stripper tube is generally collected at the ends of the tube and drained into a tank beneath the belt. However, because of the drainpipe structure extending between the vacuum stripper tube and the tank, contaminated air and liquid are frequently withdrawn back into the system in a manner which will impair the suction force applied to the vacuum stripper tube. In addition, the blow-off unit employed upstream of each treating station and the blower providing the suction force for the vacuum stripper tube are each driven by separate motors such that the intake of the blow-off unit is subject to handling contaminated air and the blower will blow an undesirable, contaminated mixture of excess liquid and air into a blower discharge pipe for return to the cans and the belt.

Accordingly, it is desirable to provide a system in which the vacuum induced flow which is split and travels through opposite ends of the vacuum stripper tube is better balanced so as to improve the amount of the excess liquid extracted from the cans and the belt. It is likewise desirable to provide a system having an excess liquid collection system which will prevent contaminated air and excess liquid from being withdrawn into the system in a manner which will not adversely affect the vacuum applied to the vacuum stripper tube. It is further desirable to provide a system in which the blower discharge pipe is connected to a separation device to remove any remaining contaminated excess liquid from the flow and direct a dry decontaminated air discharge into a return duct used to supply the blow-off system. It is further desirable to provide a system employing a single electric motor driven blower to supply the vacuum stripping flow and the compressed air for blow-off.

BRIEF SUMMARY OF THE INVENTION

The present invention advantageously provides a multi-station, liquid treatment system employing enhanced vacuum flow and compressed air blow-off for removing excess liquid from both hollow containers and a container-carrying conveyor belt in a manner which minimizes cross-contamination from any upstream liquid treatment station.

It is one object of the present invention to improve the distribution of vacuum flow used to remove excess liquid from the hollow containers and container-carrying belt.

It is another object of the present invention to collect excess liquid withdrawn from the hollow containers and the conveyor belt in a manner which will maintain such excess liquid in a collection tank.

It is a further object of the present invention to extract wet, contaminated air from the hollow articles on the conveyor belt, separate the wet air for reentry into the system and utilize the dry air for downstream blow-off of the hollow articles.

In one aspect of the invention, a liquid treatment system for hollow articles having an open end facing downwardly upon a moving conveyor belt includes a vacuum stripper tube for carrying a suction force for withdrawing excess liquid from the belt and from the hollow articles on the belt. The vacuum stripper tube has a top surface, a bottom surface and a pair of splitters for distributing the suction force applied to opposite ends of the vacuum stripper tube. The improvement comprises a baffle disposed within the vacuum stripper tube for further improving the distribution of suction force applied in the vacuum stripper tube. The baffle is oriented generally transverse to the longitudinal axis of the vacuum stripper tube. The baffle has an upper edge and a lower edge, at least the upper edge being spaced from the top surface of the vacuum stripper tube to ensure flow equalization. The baffle is a planar element located equidistant from each of the splitters in the center of the vacuum stripper tube.

In another aspect of the invention, a liquid treatment system for hollow articles transported upon a moving conveyor belt comprises a vacuum stripper tube for withdrawing excess liquid from the hollow articles and the belt. A vacuum pipe system is connected to the vacuum stripper tube for carrying a suction force to the vacuum stripper tube. The vacuum pipe system includes a sump connected to the vacuum stripper tube for collecting of excess fluid withdrawn from the vacuum stripper tube. An excess liquid collection arrangement is constructed and arranged to establish a one-way flow of and collect the excess liquid from the sump. The excess liquid collection arrangement comprises a tank positioned beneath and upstream of the vacuum stripper tube for collecting excess liquid from the hollow articles the conveyor belt and the sump, the tank having an air space creating a head above the excess liquid collected therein. A drainpipe system is connected between the sump and the tank for allowing the excess liquid to drain into the tank. The drainpipe system creates a trap preventing the excess liquid from being withdrawn into the vacuum pipe system and prohibiting air in the air space from being evacuated from the tank. The drainpipe system includes a generally horizontally disposed drainpipe extending from the pump to the air space above the excess liquid in the tank. The drainpipe system further includes a generally vertically disposed drainpipe extending between the generally horizontally disposed drainpipe and the excess liquid in the tank. The generally vertically disposed drainpipe has a length which is greater than the head created in the tank and has a bottom end continuously submerged in the excess liquid in the tank.

In yet another aspect of the invention, a system for applying and removing liquid relative to hollow articles transported along a moving conveyor belt comprises a vacuum stripper tube for withdrawing excess liquid from the hollow articles and the conveyor belt. A vacuum pipe system is joined to the vacuum stripper tube and has a blower and a blower discharge pipe. The blower generates a suction force for the vacuum stripper tube such that a combination of excess liquid and air from the vacuum stripper tube is fed to the blower discharge pipe for returning the excess liquid and air to the hollow articles on the conveyor belt. A blow-off unit is operably connected to the blower for supplying dry air to the hollow articles on the conveyor belt. A separation device is mounted on the blower discharge pipe for separating the combination of excess liquid and air into separated excess liquid and dry air. The separation device includes an inlet pipe for receiving the combination of the excess liquid and air from the blower discharge pipe, an outlet pipe for returning the separated excess liquid into the system upstream of the blow-off unit, and a blower duct for delivering the separated dry air to the blow-off unit. The blow-off unit is located adjacent the conveyor belt upstream of the blower and is dependent upon the blower.

Various other objects, features and advantages of the invention will be made apparent from the following description taken together with the drawings.

BRIEF DESCRIPTION OF THE SEVERAL VIEWS OF THE DRAWING

The drawings illustrate the best mode presently contemplated of carrying out the invention. In the drawings.

DETAILED DESCRIPTION OF THE INVENTION

Figure 1:
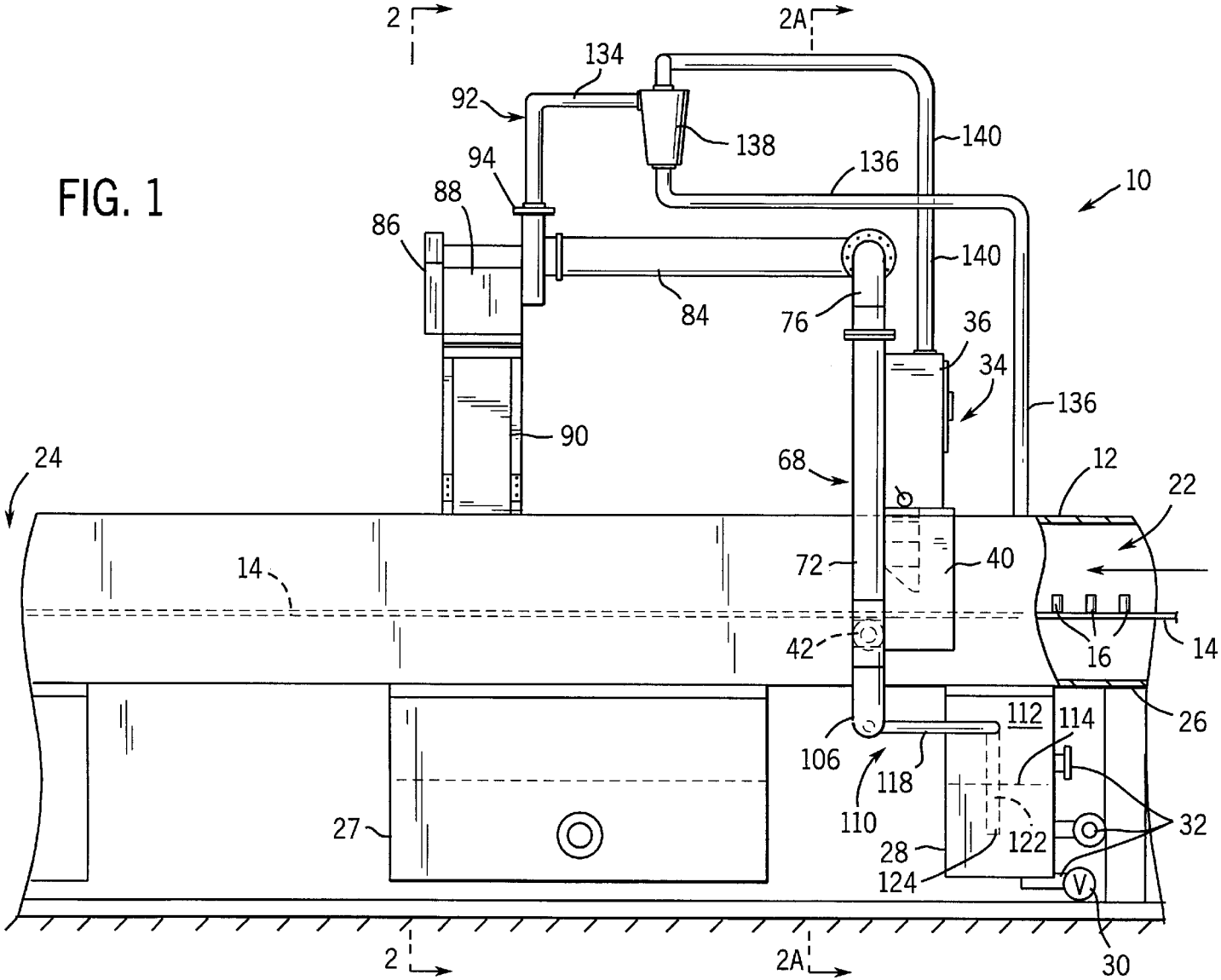
FIG. 1 is a fragmentary side elevational view of a representative station of a can washing system embodying the present invention.

Referring to FIG. 1, reference numeral 10 designates a typical preliminary rinse station in a liquid treatment system, preferably a can washing system, comprising a tunnel 12 in which multiple surface treatment processes take place continuously throughout a series of pre-wash, acid cleaning, drag-out, preliminary rinse, surface fixing and two final rinse stations. An endless conveyor belt 14 comprising an open mesh steel framework supports hollow articles 16, preferably in the form of can bodies, in spaced apart, inverted positions with their dished bottoms up, and travels through the individual treatment stations. It should be understood that the spacing of the can bodies 16 is exaggerated in FIGS. 1 and 2, and that, in actuality, the conveyor is fully loaded with very closely spaced, densely packed can bodies 16 covering substantially the entire upper surface of conveyor belt 14 so as to maintain the stability of the can bodies 16. As the inverted can bodies 16 advance in the direction, as shown by the arrow, they proceed from an upstream station 22 through preliminary rinse station 10 to a downstream station 24. As is well known, a plurality of particularly oriented nozzles (not shown) are provided above and beneath conveyor belt 14 for directing various sprays of water and liquid chemical treatment against can bodies 16. In addition, the bottom 26 of the tunnel 12 is conventionally formed to channel the sprayed excess liquid into different collection tanks such as the tank 27 located beneath the treatment stations. It should be understood by the reader that the preferred embodiment describes a typical rinse station in a can washing system, but that the principles of the invention encompass any liquid treatment station in a liquid treatment system.

Figure 5:
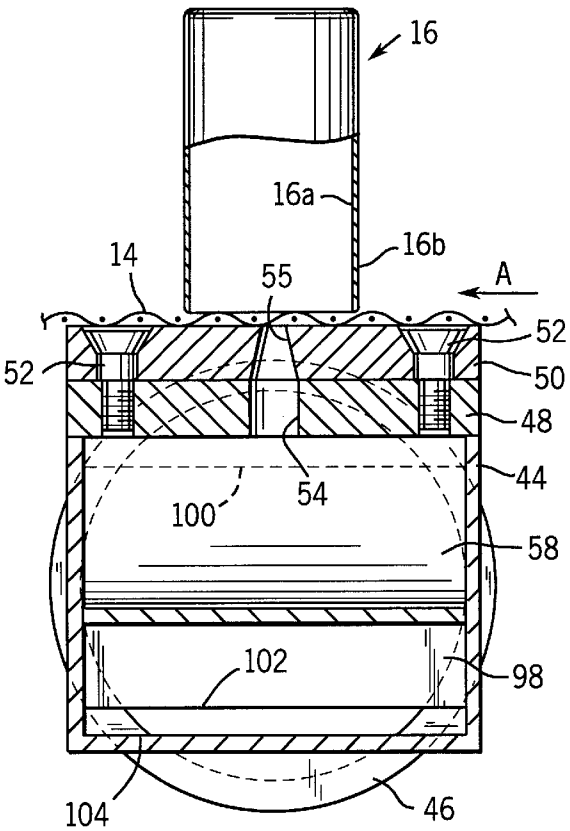
FIG. 5 is an enlarged sectional view of the vacuum stripper tube taken on line 5—5 of FIG. 4.

Looking more closely at FIG. 1, inverted can bodies 16 exit from the upstream station 22 where they receive a rinse which is collected in a tank 28 located under the tunnel 12. Tank 28 is commonly equipped with a suitable valve 30, and pipes 32 to control ingress and egress of liquid relative to tank 28. As they continue to advance, the can bodies 16 carry excess liquid in their dished bottoms as well as on their inner and outer surfaces 16*a*, 16*b*, respectively (FIG. 5). Excess liquid in the dished bottoms is blown out by compressed air from a blow-off unit 34 positioned above and downstream of tank 28. The blow-off unit 34 typically includes a blower 36 and a blow-off header 40 which overlies can bodies 16 on conveyor belt 14 so as to properly direct a blast of compressed air which will effectively remove the excess liquid in the dished bottoms of the can bodies 16.

Immediately upon passing through the blow-out header 40, the can bodies 16 traverse over a vacuum stripper tube 42 which is best illustrated in FIGS. 2–5. Vacuum stripper tube 42 typically includes an elongated, tubular base 44 of rectangular cross-section which is interposed between a pair of cylindrical pipe stubs 46. The top of the base 44 is provided with a support plate 48 on top of which a stripper pad 50 is secured by fasteners 52. Both the support plate 48 and the stripper pad 50 are provided with aligned apertures 54, 55 (FIG. 5) which together form a series of spaced apart slots 56 placing the inside surfaces 16*a* of the can bodies 16 riding on the open conveyor belt 14 in communication with the inside of the vacuum stripper base 44. Secured within the vacuum stripper base 44 is a pair of flow splitters 58, each of which is a curved plate having an inner end 60 which is joined to a central portion of vacuum stripper base 44, and an outer end 62 which is joined to an end cap 64 inwardly of pipe stub 46. The splitters 58 also have an intermediate portion 66 which extends axially of the base 44.

Figure 2:
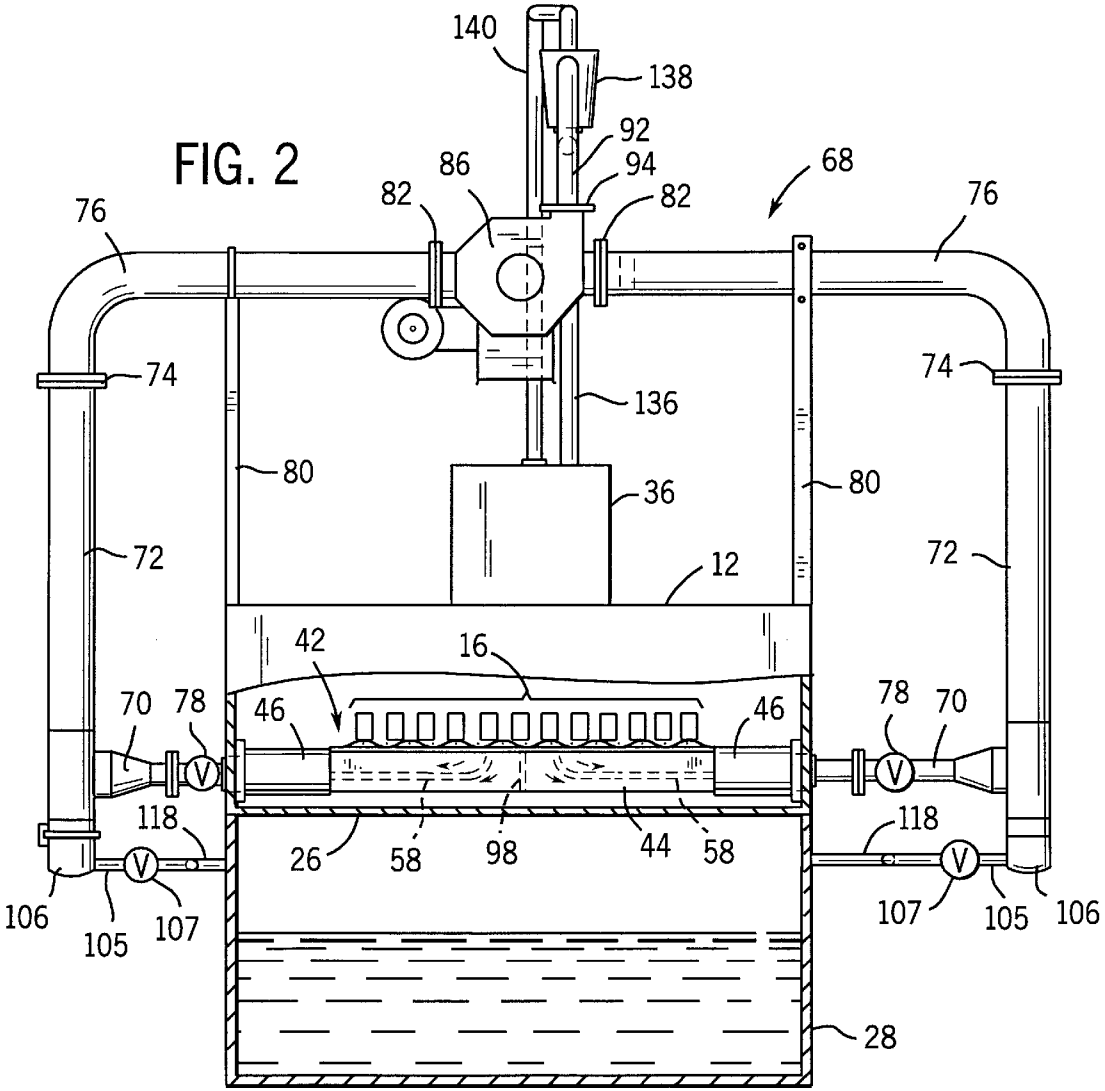
FIG. 2 is a partial sectional view with parts broken away taken on line 2—2 of FIG. 1.

Turning particularly to FIGS. 1 and 2, vacuum stripper tube 42 is connected to a vacuum pipe system 68 which provides a vacuum source and establishes a flow path between the vacuum source and vacuum stripper tube 42. Vacuum pipe system 68 includes a pair of connection lines 70 extending laterally from each side of the tunnel 12 for connecting the pipe stubs 46 to a pair of lower vacuum pipes 72 which in turn are joined at flanges 74 to a pair of upper vacuum pipes 76. A suitable valve 78 is interposed in the right side connection line 70 to selectively open and close the line to fluid flow therethrough. Each of the upper vacuum pipes 76 is maintained in position by support braces 80 extending upwardly from the top of tunnel 12, and terminates at its upper end in a flange 82 which is secured to a horizontally and forwardly extending blower pipe 84. Mounted at the end of blower pipe 84 is a blower 86 driven by an electric motor 88 supported on a pedestal or stand 90 (FIG. 1). A blower discharge pipe 92 rising upwardly has an lower end 94 connected to blower 86. With this arrangement, the blower 86 defines a suction force which draws excess liquid from the inside and outside surfaces 16*a*, 16*b* of the can bodies 16 as well as from the conveyor belt 14 into the vacuum stripper tube 42, the distribution of the vacuum flow being assisted by the flow splitters 58.

In accordance with one feature of the invention, a baffle 98 is centrally positioned in the vacuum stripper tube 42 to further improve the distribution of vacuum flow therein in a manner heretofore unattainable with the splitters 58. Baffle 98 is a generally rectangular planar element secured transversely to the longitudinal axis of the vacuum stripper tube 42 across the base 44 at a location substantially equidistant from the inner ends 60 of the splitters 48. The baffle 98 has an upper flat edge 100 (FIG. 5) which is spaced slightly from the bottom of the support plate 48, and a bottom flat edge 102 which is elevated slightly from the bottom 104 of base 44. The spacing of upper flat edge 100 functions to provide an improved pressure equalization of the vacuum flow emanating from the center of the base 44, while the spacing of the lower flat edge 102 prevents the excess liquid from puddling on the flat bottom 104 of the base 44. As will be further appreciated hereafter, the baffle 98 cooperates with the flow splitters 58 to enhance the vacuum flow within the vacuum stripper tube 42 to optimize the excess liquid extracted from both the conveyor belt 14 and the can bodies 16.

Excess liquid and air suctioned outwardly from the vacuum stripper tube 42 are delivered through opened connection lines 70 to the bottom portion of each lower vacuum pipe 72. It is important to understand that the excess liquid dropping from the can bodies 16 and belt 14 carries contaminates transferred from the mesh conveyor which is in direct contact with the open end of the can bodies 16. That is, the conveyor belt 14 being exposed to various substances in its travel through the various treatment stations cross-contaminates the excess liquid collected from the can bodies 16 in the vacuum stripper tube 42. Such contamination is undesirable because it may have an effect on the coating of the can bodies 16 in a later process. Each pipe 72 forms a sump 106 into which the majority of the contaminated excess liquid extracted from vacuum stripper tube 42 falls, with the remaining combination of the contaminated air and liquid being transported as moist air through the vacuum pipe system 68. The left-side sump 106 is provided with a drainline 105 and a suitable valve 107 if it is desirable to drain fluid therefrom. In prior art devices, excess fluid removed from the conveyor belt 14 and can bodies 16 is simply drained to a collection tank beneath the tunnel in a manner such that air and excess liquid can be withdrawn from the collection tank. Not only does this withdrawal deleteriously affect the suction force supplied by the blower 86, but it also reintroduces contaminated fluid back into the system which, as noted above, can negatively impact on the quality of further processes such as painting of the can bodies 16.

Figure 2A:
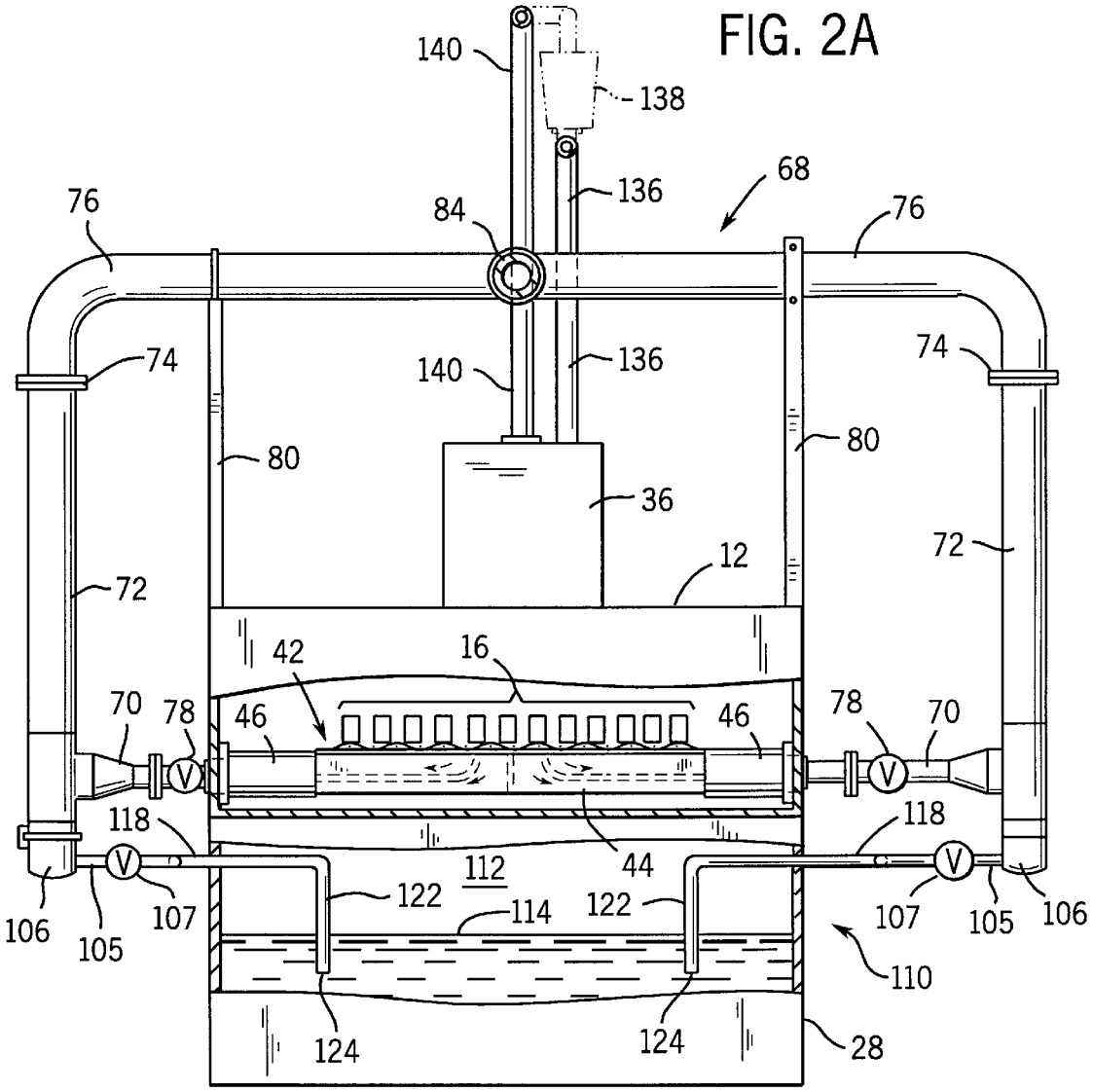
FIG. 2A is a partial sectional view with parts broken away taken on line 2A—2A of FIG. 1.
Figure 3:
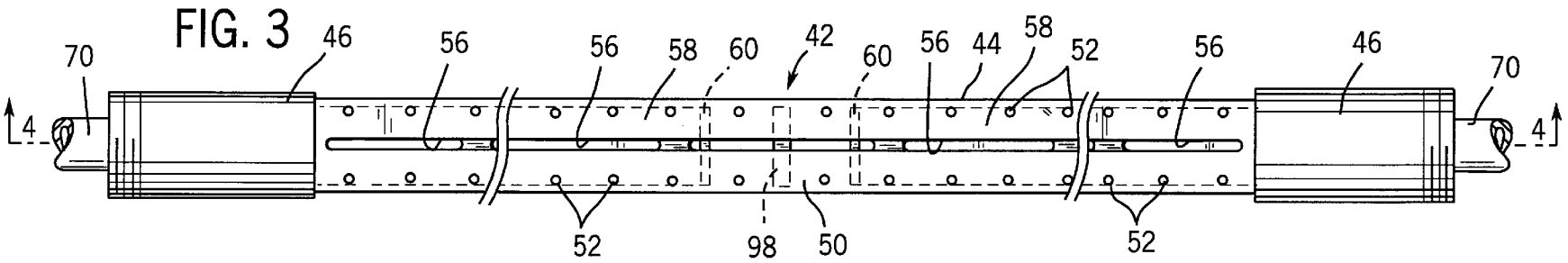
FIG. 3 is a top view of a vacuum stripper tube employed in the present invention.
Figure 4:
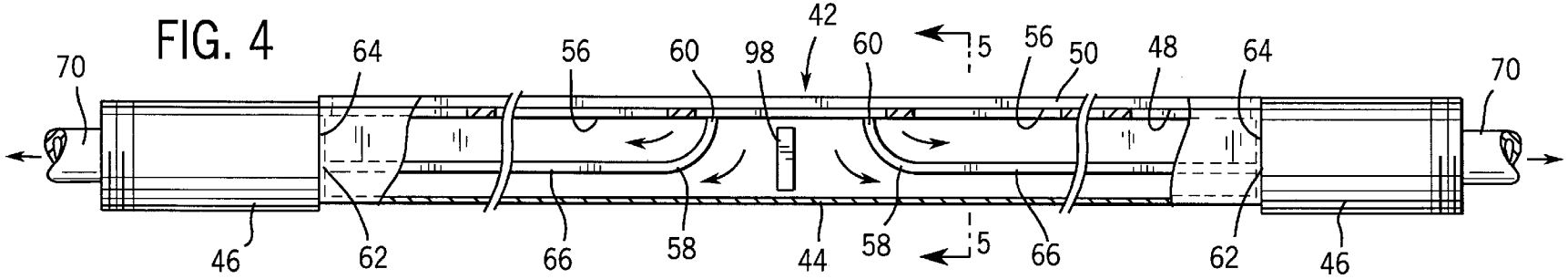
FIG. 4 is a sectional view with parts broken away taken on line 4—4 of FIG. 3.

In accordance with another feature of the invention best depicted in FIGS. 1 and 2A, the contaminated excess liquid collected in the right side sump 106 is led to the upstream collection tank 28 beneath the tunnel 12 or to a drain (not shown) through a drainpipe system 110 which provides one-way flow of fluid from the sump 106. Collectively, the tank 28, its connection to drain, and drainpipe system 110 form an excess liquid collection arrangement. The tank 28 has a changeable air space 112 defining a head between the bottom 26 of the tunnel 12 and the upper surface 114 of the collected excess liquid. Contaminated fluid collected in the left side sump 106 is selectively drained through the horizontally extending drain line 105 extending into the tank 28. Drainpipe system 110 includes a first generally horizontally disposed, straight drainpipe 118 (FIG. 1) extending from sump 106 to a second generally horizontally extending, straight drainpipe (not shown) extending substantially perpendicularly thereto. Drainpipe 118 is provided with a suitable valve 107 if it is desired to drain liquid from right side sump 106. Drainpipe 118 has an end extending into the air space 112 above the collected excess fluid and is connected to a generally vertically and downwardly disposed straight drainpipe 122 extending between drainpipe 118 and tank 28. According to the invention, vertically disposed drainpipe 122 has a length which is always greater than the head 112 created in the tank 28, and includes a bottom end 124 continuously submerged at least one inch below the excess liquid in tank 28. As shown in FIG. 1, tank 28 is provided with overflow pipes 32 for delivering excess fluid to drain once the excess liquid rises to an excessive level.

The drainpipe system 110 set forth above effectively creates a trap which prevents contaminated excess liquid from being withdrawn into the vacuum pipe system 68 and also prohibits air in the air space 112 from being evacuated from the tank 28. As a result, a strong vacuum force can be maintained so as to suction and remove as much excess liquid as possible before the can bodies 16 and conveyor belt 14 move to the next station. In addition, the return of contaminated liquid is limited to the small amount withdrawn into the vacuum pipe system 68 which is further decontaminated as described below.

With further reference to FIG. 1 and in accordance with yet another feature of the invention, blower discharge pipe 92 includes an input line 134 and an output line 136. Both the input and output lines 134, 136 are connected to a filtered, separation device 138, such as a cyclone separator, for separating the combination of liquid and air from the moist contaminated air withdrawn into the vacuum pipe system 68 and blown in to the blower discharge pipe 92 by blower 86. Extending from the top of the cyclone separator 138 is a blow-off duct 140 which connects with the blow-off unit 34 located adjacent the conveyor belt 14 upstream of the blower 86. Incorporating the separation device 138 into the blower discharge pipe 92 enables compressed filtered and decontaminated air to be supplied via blow-off duct 40 to blow-off unit 34 so as to remove excess liquid from the advanced conveyor belt 14 and can bodies 16. Also, separation device 138 serves to separate excess liquid from the moist air and return that separated excess liquid back into the output line 136 for return to the top of the tunnel 12 upstream of blow-off unit 34. Unlike prior art upstream blow-off units, there is no need to drive blow-off unit 34 with a separate electric motor directly attached thereto. Instead, the electric motor 88 and blower 86 provide the driving force for delivering compressed air to the blow-off header 36 of blow-off unit 34 in addition to providing the vacuum source for vacuum tube stripper 42. Making the blow-off unit 34 dependent on the blower 86 is an important advantage which demonstrates both energy efficiency and contamination consciousness.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with following claims.

I claim:

1. A container washing system having a plurality of liquid treatment stations for applying and removing liquid relative to a group of containers carried on a conveyor belt movable along the liquid treatment stations, the system comprising:

a fixed, elongated vacuum stripper tube to be located beneath the conveyor belt for carrying a suction force withdrawing excess liquid from the conveyor belt and the containers carried on the conveyor belt, said vacuum stripper tube including a top surface, a bottom surface, a pair of sidewalls, and a pair of opposed ends in communication with a source of suction force;

a pair of flow splitters fixedly mounted in said vacuum stripper tube for distributing the suction force applied to said opposite ends of said vacuum stripper tube, each of said flow splitters being a curved plate having an inner end joined to a central portion of said vacuum stripper tube, an intermediate portion flowing from said inner end and extending axially of said vacuum stripper tube, and an outer end extending from said intermediate portion and connected to one of said opposite ends of said vacuum stripper tube, each of said flow splitters being symmetrically positioned on one side of said vacuum stripper tube; and a fixed flow enhancing baffle centrally disposed in said vacuum stripper tube between said inner ends of the flow splitters and having a pair of side edges secured to said sidewalls of said vacuum stripper tube, said baffle cooperating with said flow splitters to enhance the vacuum flow within said vacuum stripper tube to optimize excess liquid extracted from the conveyor belt and the containers carried thereon.

2. The improvement of claim 1, wherein said baffle is oriented generally transverse to the longitudinal axis of said vacuum stripper tube.

3. The improvement of claim 1, wherein said baffle has an upper edge and a lower edge, at least said upper edge being spaced from said top surface of said vacuum stripper tube.

4. The improvement of claim 3, wherein said lower edge is spaced from said bottom surface of said vacuum stripper tube.

5. The improvement of claim 1, wherein said baffle is a planar element located equidistant from each of said splitters in the center of said vacuum stripper tube.

6. In a can washing apparatus having a group of hollow, inverted cans which are washed as they travel along a moving conveyor belt, excess liquid dropping from the conveyor belt and cans supported thereon carrying contaminants transferred from the conveyor belt, a contaminated excess liquid removal system comprising:

vacuum stripping means for withdrawing excess contaminated liquid from the conveyor belt and the cans;

vacuum pipe means connected to opposite ends of said vacuum stripping means and including a blower means for carrying a suction force to said vacuum stripping means, and collecting a minority portion of combined excess contaminated liquid and air therefrom, said vacuum pipe means including sump means connected to said vacuum stripping means for collecting a majority portion of excess contaminated liquid withdrawn from said vacuum stripping means and depositing the excess contaminated liquid in a closed collection means preventing excess contaminated liquid from being withdrawn into said vacuum pipe means and prohibiting air above the excess contaminated liquid from being evacuated, said vacuum pipe means further including a separation means connected to said blower means for separating the combined excess contaminated liquid and air into decontaminated excess liquid and decontaminated dry air returned to the conveyor belt and the cans; and blow-off means connected to said blower means and positioned upstream of said vacuum stripping means for delivering dry decontaminated air to the cans.

7. The system of claim 6, wherein said blower means includes a single electric motor means for delivering said dry contaminated air to said blow-off means and providing a vacuum source for said vacuum stripping means.

8. A method for removing contaminated liquid from a group of cans being washed on a movable conveyor belt, the method comprising the steps of:

providing a vacuum stripping means for withdrawing contaminated liquid from the conveyor belt and the cans;

connecting a vacuum pipe means having a blower means to opposite ends of said vacuum stripping means for carrying a suction force to said vacuum stripping means and collecting a minority portion of combined excess contaminated liquid and air therefrom;

supplying said vacuum pipe means with a sump means connected to said vacuum stripping means for collecting a majority portion of excess contaminated liquid withdrawn from said vacuum stripping means and depositing said excess contaminated liquid into a closed collection means preventing said excess contaminated liquid from being withdrawn into said vacuum pipe means and prohibiting air above said excess contaminated liquid from being evacuated;

connecting a separating means to said blower means for separating said combined excess contaminated liquid and air into decontaminated excess liquid and decontaminated dry air;

providing said blower means with a blow-off means positioned upstream of said vacuum stripping means for delivering said decontaminated dry air to the cans; and delivering said decontaminated excess liquid to the cans and the conveyor belt upstream of said blow-off means.

* * * * *